US005983665A

United States Patent [19]

Howard et al.

[11] Patent Number: 5,983,665

[45] Date of Patent: Nov. 16, 1999

[54] PRODUCTION OF REFRIGERATED LIQUID METHANE

[75] Inventors: Lee Jarvis Howard, Pikeville; Howard Charles Rowles, Center Valley; Richard Alan Wright, Macungie; Christopher Francis Harris, Old Zionsville; Glenn Eugene Kinard, Allentown; Robert Newton Davis, Breinigsville, all of Pa.

[73] Assignee: Air Products and Chemicals, Inc., Allentown, Pa.

[21] Appl. No.: 09/034,052

[22] Filed: Mar. 3, 1998

[51] Int. Cl.[6] ..... F25J 1/00

[52] U.S. Cl. ..... 62/623; 62/627

[58] Field of Search ..... 62/627, 623

[56] References Cited

U.S. PATENT DOCUMENTS

| | | | |
|---|---|---|---|
| 3,837,172 | 9/1974 | Markbreiter et al. | 62/24 |
| 4,002,042 | 1/1977 | Pryor et al. | 62/627 |
| 4,270,939 | 6/1981 | Rowles et al. | 62/28 |
| 4,270,940 | 6/1981 | Rowles et al. | 62/38 |
| 4,622,053 | 11/1986 | Tomlinson et al. | 62/26 |
| 4,714,487 | 12/1987 | Rowles | 62/24 |
| 4,720,293 | 1/1988 | Rowles et al. | 62/24 |
| 4,732,598 | 3/1988 | Rowles et al. | 62/28 |
| 4,749,393 | 6/1988 | Rowles et al. | 62/24 |
| 4,857,078 | 8/1989 | Watler | 55/16 |
| 4,921,514 | 5/1990 | Rowles et al. | 62/24 |
| 5,114,451 | 5/1992 | Rambo et al. | 62/24 |
| 5,287,703 | 2/1994 | Bernhard et al. | 62/627 |
| 5,359,856 | 11/1994 | Rhoades et al. | 62/9 |
| 5,390,499 | 2/1995 | Rhoades et al. | 62/9 |
| 5,414,190 | 5/1995 | Forg et al. | 585/802 |
| 5,505,049 | 4/1996 | Coyle et al. | 62/11 |
| 5,592,832 | 1/1997 | Herron et al. | 62/646 |
| 5,596,883 | 1/1997 | Bernhard et al. | 62/618 |
| 5,600,969 | 2/1997 | Low | 62/622 |
| 5,615,561 | 4/1997 | Houshmand et al. | 62/611 |
| 5,802,871 | 9/1998 | Howard et al. | 62/627 |

OTHER PUBLICATIONS

Bernhard, D. P., et al., "Recovery of Valuable Hydrocarbons Using Dephlegmator Technology", *Advances in Cryogenic Engineering,* vol. 33, 1988, pp. 983–989.

*Primary Examiner*—Ronald Capossela
*Attorney, Agent, or Firm*—John M. Fernbacher

[57] ABSTRACT

A high purity methane product is recovered from a feed gas mixture containing methane and one or more hydrocarbons heavier than methane by cooling, condensing, and rectifying the feed in a dephlegmator. The high purity methane product, containing at least 98 mole % methane, can be liquefied and stored for use as a fuel for internal combustion engines. A hydrocarbon product containing components heavier than methane is also recovered.

Methane recovery and $C_2^+$ hydrocarbon product purity can be improved by the use of a combined stripping heat exchanger and feed gas cooler. External refrigeration is utilized and can be supplemented in part by autorefrigeration provided by vaporizing dephlegmator liquid.

21 Claims, 4 Drawing Sheets

PRODUCTION OF REFRIGERATED LIQUID METHANE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

A clean-burning alternative fuel for internal combustion engines is provided by the vaporization of high purity liquid methane. The operation of internal combustion engines on vaporized liquid methane fuel requires that the methane be of high purity, typically containing at least 98 mole % methane and preferably less than 0.5 mole % of hydrocarbons heavier than methane. High purity liquid methane can be produced from natural gas by known methods for separating methane from the heavier hydrocarbons which are present in natural gas. Technology for the storage and vaporization of liquid methane is known for both vehicular and stationary applications.

Natural gas can be processed by cryogenic distillation to remove hydrocarbon components heavier than methane and non-hydrocarbon components lighter than methane. This well-known technology is described in representative U.S. Pat. Nos. 3,837,172, 4,857,078, 5,114,451, 5,359,856, 5,390,499, 5,600,969, and 5,615,561. Combined cryogenic and non-cryogenic processes also have been used to produce high purity methane as described for example in U.S. Pat. No. 5,414,190.

Refluxing heat exchangers, also known as dephlegmators, have been used widely in combination with cryogenic distillation to separate hydrocarbon-containing mixtures. Dephlegmator technology is discussed in the review article entitled "Recovery of Valuable Hydrocarbons Using Dephlegmator Technology" by D. P. Bernhard and H. C. Rowles in *Advances in Cryogenic Engineering*, Vol 33, 1988, pp. 983–989. Representative processes using dephlegmators for the separation of hydrocarbon mixtures, some of which contain hydrogen and/or nitrogen, are described in U.S. Pat. Nos. 4,270,939, 4,270,940, 4,622,053, 4,714,487, 4,749,393, 4,720,293, 4,732,598, and 4,921,514.

Dephlegmators offer simple, reliable, and efficient operation for a wide variety of gas separations. They are particularly useful in the separation of mixtures of lower molecular weight components, which separation generally requires significant amounts of low temperature refrigeration. The invention described in the present specification and defined by the claims which follow is an efficient process utilizing dephlegmators for the production of high purity liquid methane.

BRIEF SUMMARY OF THE INVENTION

The invention is a method for recovering methane from a feed gas mixture containing methane and one or more hydrocarbons heavier than methane which comprises:

(a) cooling the feed gas in a feed cooling heat exchange zone;

(b) further cooling, condensing, and rectifying the resulting cooled feed gas of step (a) in a dephlegmator to produce a cold methane vapor product and a hydrocarbon liquid enriched in the one or more hydrocarbons heavier than methane; and (c) vaporizing at least a portion of the hydrocarbon liquid of step (b) in the feed cooling heat exchange zone to provide by indirect heat exchange at least a portion of the refrigeration required to cool the feed gas in step (a), and withdrawing a vaporized hydrocarbon product from the feed cooling heat exchange zone.

The cold methane vapor product can be cooled and condensed to yield a high purity liquid methane product which contains at least about 98 mole % methane. The high purity liquid methane product typically contains less than about 0.5 mole % of hydrocarbons heavier than methane.

At least a portion of the refrigeration required to cool the feed gas in the feed cooling heat exchange zone and to cool, condense, and rectify the cooled feed gas can be provided by a closed-loop multicomponent refrigeration system. The closed-loop multicomponent refrigeration system can utilize a refrigerant comprising nitrogen, methane, and one or more hydrocarbons heavier than methane.

A portion of the hydrocarbon liquid of step (b) can be withdrawn as a liquid product, and if desired a portion of the vaporized hydrocarbon product can be recycled and combined with the feed gas prior to step (a) to increase methane recovery. At least a portion of the refrigeration required to cool and condense the cold methane vapor product can be provided by an external refrigeration source, and the external refrigeration source can be a closed-loop multicomponent refrigeration system.

At least a portion of the vaporization of the hydrocarbon liquid in step (c) in the feed cooling heat exchange zone can be effected in one or more vertical passages such that the hydrocarbon liquid flows downward while hydrocarbon vapor formed therein flows upward and provides a stripping medium which enhances mass transfer between the vapor and liquid phases, and wherein the vapor thus formed is withdrawn from the feed cooling heat exchange zone and is introduced into the dephlegmator. If desired, a portion of partially vaporized hydrocarbon liquid can be withdrawn from an intermediate point of the feed cooling heat exchange zone. The remaining portion of the partially vaporized hydrocarbon liquid can be further vaporized in the feed cooling heat exchange zone to provide the vaporized hydrocarbon product withdrawn therefrom. A portion of the vaporized hydrocarbon product can be recycled and combined with the feed gas prior to step (a) to increase methane recovery.

An alternative embodiment of the invention as illustrated in FIG. 4 is a method for recovering methane from a feed gas mixture containing methane and one or more hydrocarbons heavier than methane which comprises:

(a) cooling the feed gas in a feed cooling heat exchange zone;

(b) further cooling, condensing, and rectifying the resulting cooled feed gas of step (a) in a dephlegmator to produce a cold methane vapor product and a hydrocarbon liquid enriched in the one or more hydrocarbons heavier than methane;

(c) subcooling at least a portion of the hydrocarbon liquid of step (b), reducing the pressure of the resulting subcooled liquid, and warming the resulting reduced-pressure hydrocarbon stream in the dephlegmator to provide by indirect heat exchange at least a portion of the refrigeration for the cooling and rectifying in step (b); and (d) removing from the dephlegmator an intermediate temperature hydrocarbon stream.

The subcooling of the hydrocarbon liquid of step (c) can be effected by indirect heat exchange with the reduced-pressure hydrocarbon stream in the dephlegmator. The intermediate temperature hydrocarbon stream removed from the dephlegmator can be warmed by indirect heat exchange with the feed gas in the feed cooling heat exchange zone to provide at least a portion of the refrigeration required to cool the feed gas, and a warm vaporized hydrocarbon stream withdrawn therefrom. A portion of the warm vaporized hydrocarbon stream can be recycled and combined with the feed gas prior to step (a). The cold methane vapor product of step (b) can be cooled and condensed to yield a high purity liquid methane product.

At least a portion of the refrigeration required to cool the feed gas in the feed cooling heat exchange zone and to cool and condense the cold methane vapor product can be provided by a closed-loop multicomponent refrigeration system. The closed-loop multicomponent refrigeration system typically utilizes a refrigerant comprising nitrogen, methane, and one or more hydrocarbons heavier than methane.

DETAILED DESCRIPTION OF THE INVENTION

The present invention is a process to purify natural gas or other methane-rich gas mixtures to recover a high purity liquid methane product containing at least 98 mole % methane which is suitable for use as a fuel for internal combustion engines. The high purity liquid methane product described herein is known as refrigerated liquid methane to distinguish it from liquefied natural gas (LNG). Refrigerated liquid methane fuel, known commercially as RLM® fuel, typically has a higher methane purity than LNG and contains at least 98 mole % methane and preferably less than 0.5 mole % of hydrocarbons heavier than methane.

Figure 1:
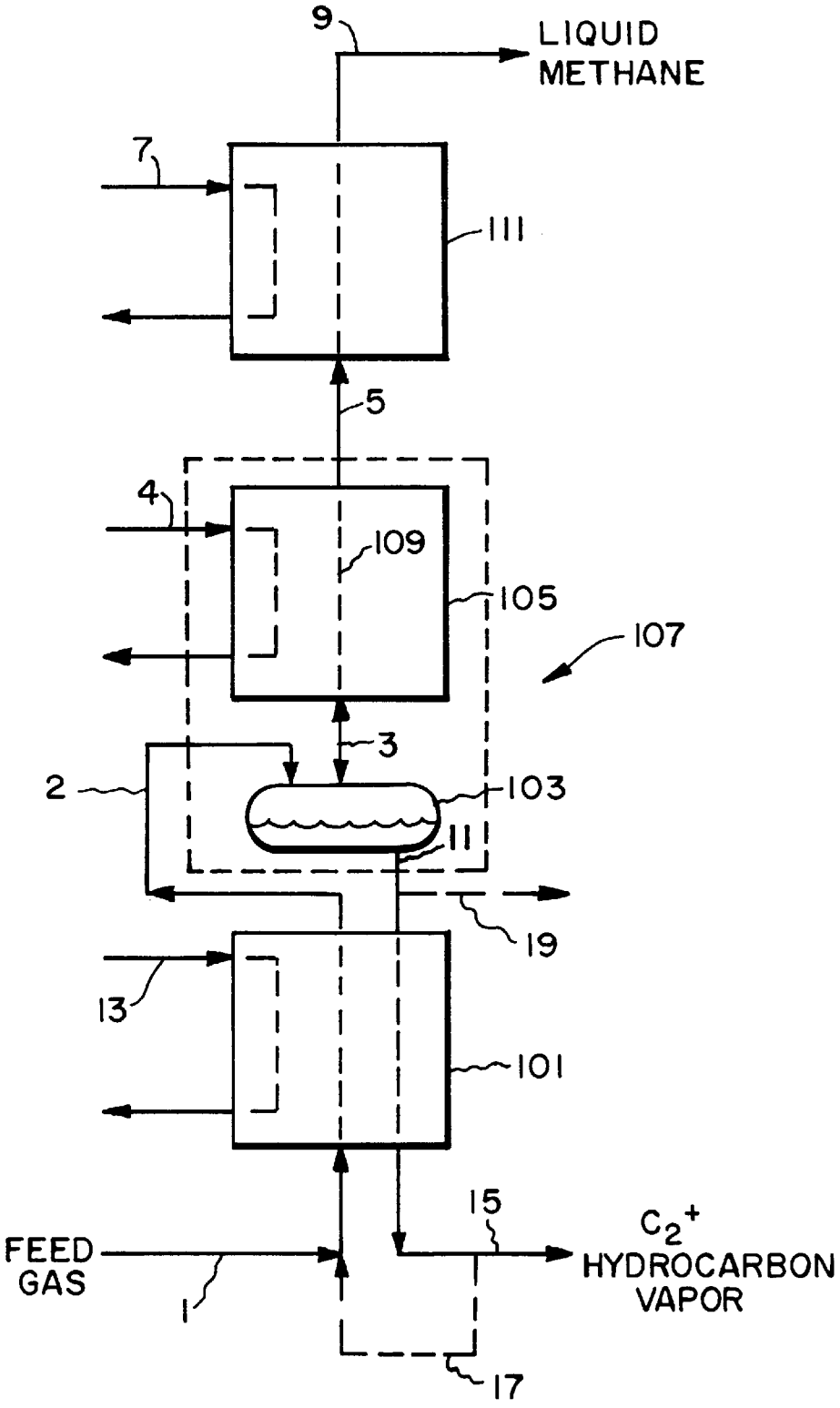
FIG. 1 is a schematic flow diagram of an embodiment of the present invention.

A first embodiment of the invention is shown in FIG. 1. Natural gas or other methane-rich feed gas in line 1, which typically contains 50 to 98 mole % methane with the remainder comprising hydrocarbons heavier than methane and optionally nitrogen, is cooled to near its dew point in feed cooling heat exchanger 101 and any condensed liquid in the feed stream in line 2 is separated in dephlegmator feed drum 103 of dephlegmator 107. Uncondensed vapor flows through line 3 into dephlegmator heat exchanger 105 wherein the vapor is further cooled, condensed, and rectified to remove most of the remaining $C_2$ and heavier hydrocarbons (also defined herein as $C_2^+$ hydrocarbons) which are returned as liquid to the dephlegmator feed drum 103 via line 3. Cooling, condensing, and rectification are effected in representative flow passage 109 wherein condensing liquid flows downward in simultaneous heat and mass transfer with vapor flowing upward in the flow passage. Refrigeration can be provided by indirect heat exchange with an appropriate refrigerant supplied via line 4. Dephlegmator heat exchanger 105 typically is a brazed aluminum plate-and-fin core-type heat exchanger known in the art which includes multiple flow passages for cooling, condensing, and rectification of the vapor from line 3 and for the warming of refrigerant supplied via line 4. Dephlegmator 107 is defined herein to include dephlegmator feed drum 103, dephlegmator heat exchanger 105, and line 3.

Methane-enriched overhead vapor in line 5 is withdrawn as a cold methane product from dephlegmator 107 and is condensed and optionally subcooled in heat exchanger 111 by indirect heat exchange with an appropriate refrigerant supplied through line 7. A high purity liquid methane product containing at least 98 mole % methane is withdrawn in line 9.

Hydrocarbon condensate containing hydrocarbons heavier than methane is withdrawn in line 11 from dephlegmator feed drum 103 and is vaporized in feed cooling heat exchanger 101 to provide at least portion of the refrigeration for cooling the feed gas from line 1. Additional refrigeration can be provided as required by an appropriate refrigerant supplied via line 13. Vaporized hydrocarbon product is withdrawn in line 15 and optionally a portion of this product can be recycled via line 17 to increase the overall recovery of high purity methane liquid in line 9. If desired, a portion of the hydrocarbon condensate in line 11 can be withdrawn as a liquid hydrocarbon product via line 19.

Higher methane recovery and a higher purity $C_2^+$ hydrocarbon product stream can be achieved by partially vaporizing the hydrocarbon condensate from dephlegmator feed drum 103 in a single-stage reboiler (not shown) to remove a methane-enriched vapor for return to dephlegmator feed drum 103 for additional rectification in dephlegmator heat exchanger 105. Alternatively, the liquid in dephlegmator feed drum 103 can be stripped by introducing a warm stripping gas (not shown) into the drum liquid. Alternatively, the liquid from dephlegmator feed drum 103 can be stripped in a conventional reboiled stripping column (not shown).

Figure 2:
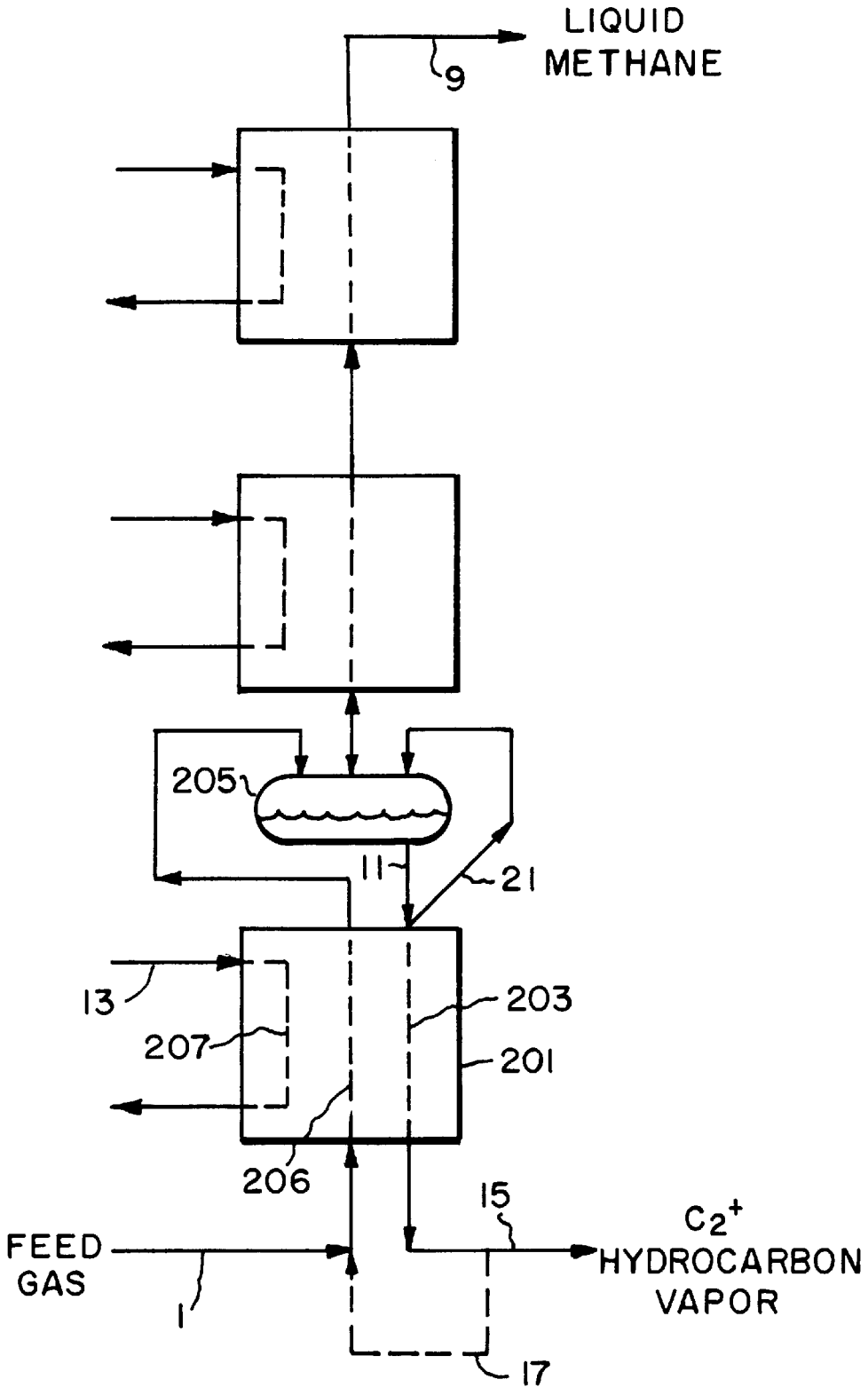
FIG. 2 is a schematic flow diagram of an alternative embodiment of the present invention.

An alternative embodiment of the invention is shown in FIG. 2 which can be utilized to increase the recovery of high purity methane product in line 9 and increase the purity of vaporized $C_2^+$ hydrocarbon product which is withdrawn in line 15. In this embodiment, feed cooling heat exchanger 101 of FIG. 1 is modified to operate as combined feed cooler and stripping heat exchanger 201 of FIG. 2. This is accomplished by installing multiple vertical flow passages illustrated by representative flow passage 203 in which hydrocarbon condensate in line 11 from dephlegmator feed drum 205 flows downward in representative flow passage 203 while being warmed and partially vaporized by indirect heat exchange from the cooling feed gas in representative flow passage 206.

The vaporizing hydrocarbon in flow passage 203 in turn provides a portion of the refrigeration required to cool the feed gas introduced via line 1. Stripped vapor flows upward in representative flow passage 203 and promotes further vaporization and mass transfer from the downward-flowing liquid therein. This countercurrent mass transfer in representative flow passage 203 reduces the methane content by stripping the downward-flowing hydrocarbon liquid, thereby increasing the methane content in the upward-flowing vapor, which in turn increases the methane recovery in the methane liquid product in line 9. Stripped vapor flowing upward in representative flow passage 203 is withdrawn from combined feed cooler and stripping heat exchanger 201 via line 21 and introduced into dephlegmator feed drum 205. Additional refrigeration is provided by refrigerant introduced through line 13 which is warmed in representative flow passage 207. Final vaporized $C_2^+$ enriched hydrocarbon product is withdrawn through line 15. Optionally, a portion of the vaporized hydrocarbon product is recycled through line 17 to increase methane recovery.

Combined feed cooler and stripping heat exchanger 201 typically is a brazed aluminum plate-and-in core-type heat exchanger which includes multiple flow passages for cooling the feed gas provided in line 1, warming the refrigerant supplied via line 13, partially vaporizing and stripping the hydrocarbon condensate provided via line 11, and removing the resulting stripped vapor through line 21. Heat exchanger 201 is a type of multiple circuit or multiple pass exchanger wherein each circuit or pass comprises multiple flow passages manifolded to distribute inlet fluid evenly to each flow passage and to withdraw outlet fluid evenly from each flow passage. The construction of the stripping passages of the plate-and-fin exchanger used in the present invention typically is the same as that used in conventional plate-and-fin exchangers. The brazed aluminum plate-and-fin heat exchanger of the type commonly used in cryogenic service is well-suited for the present invention. Stainless steel and other metals suitable for cryogenic service also can be used. The use of passages for stripping service requires no major modifications to the exchanger and therefore no additional cost would be incurred. Representative flow passage 203 is oriented vertically and the other passages also are generally oriented vertically. Warming and cooling streams preferably flow countercurrently in adjacent groups of flow passages. Stripping heat exchangers of this type are described in U.S. Pat. No. 5,596,883, which is incorporated herein by reference.

Figure 3:
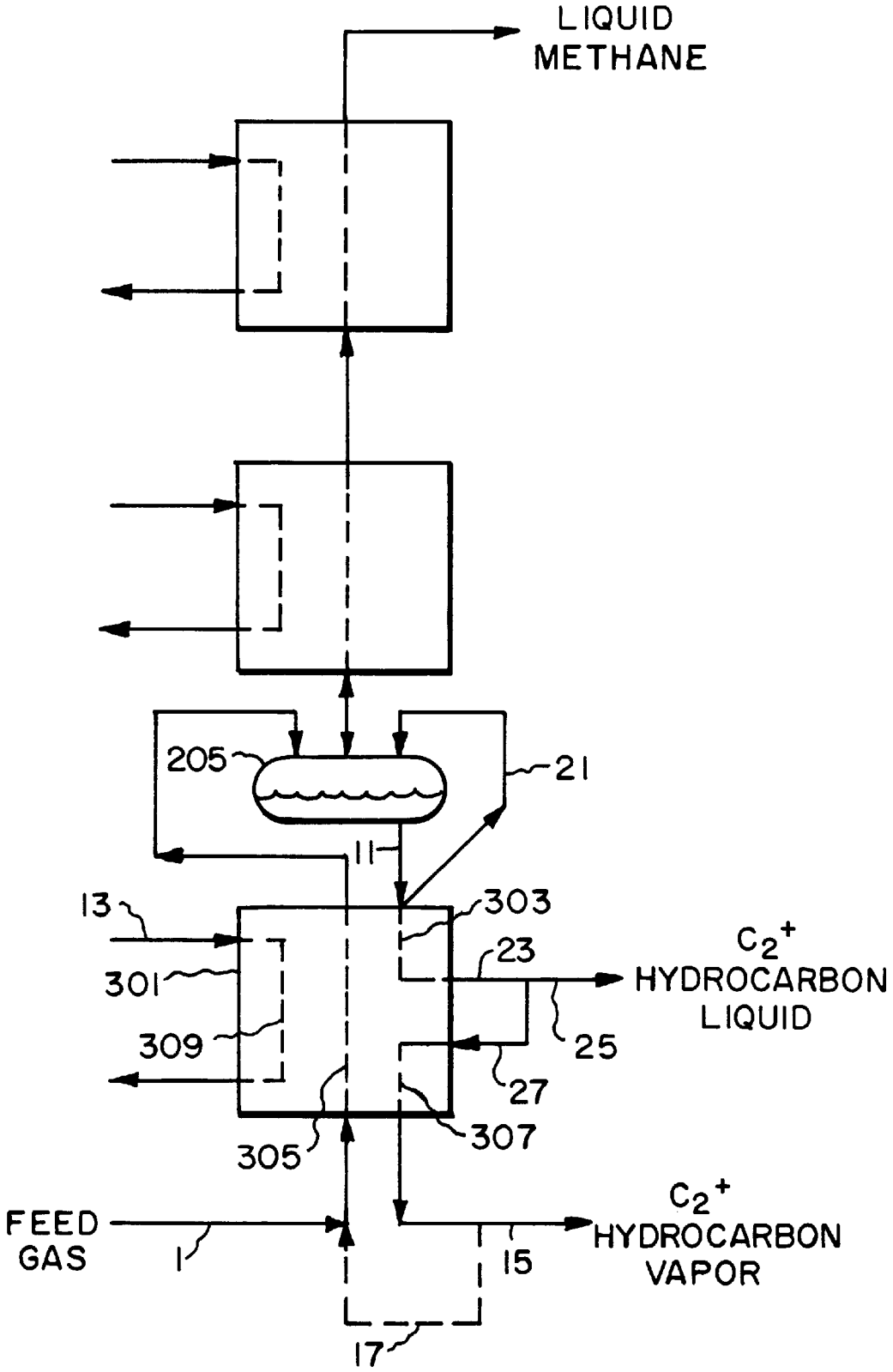
FIG. 3 is a schematic flow diagram of an alternative operating mode of the embodiment of FIG. 2.

An alternative mode of the process is shown in FIG. 3. In this alternative, combined feed cooler and stripping heat exchanger 201 of FIG. 2 is modified slightly to yield combined feed cooler and stripping heat exchanger 301 of FIG. 3. This is accomplished by installing multiple vertical flow passages illustrated by representative flow passage 303 in which hydrocarbon condensate in line 11 from dephlegmator feed drum 205 flows downward in representative flow passage 303 while being warmed and partially vaporized by indirect heat exchange with the cooling feed gas in representative flow passage 305.

The vaporizing hydrocarbon in representative flow passage 303 in turn provides a portion of the refrigeration required to cool the feed gas introduced via line 1. Stripped vapor flows upward in representative flow passage 303 and promotes further vaporization and mass transfer from the downward-flowing liquid. This countercurrent mass transfer in representative flow passage 303 reduces the methane content by stripping the downward-flowing hydrocarbon liquid, thereby increasing the methane content in the upward-flowing vapor, which in turn increases methane recovery in the methane liquid product in line 9. Stripped vapor flowing upward in representative flow passage 303 is withdrawn from combined feed cooler and stripping heat exchanger 301 via line 21 and introduced into dephlegmator feed drum 205.

$C_2^+$ enriched hydrocarbon liquid is withdrawn from an intermediate point of combined feed cooler and stripping heat exchanger 301 through line 23, a portion of the $C_2^+$ hydrocarbon liquid is withdrawn as a product through line 25, and the remaining portion in line 27 is reintroduced into the exchanger where it is warmed and completely vaporized in representative flow passage 307. The warming and vaporization in representative flow passage 307 provides by indirect heat exchange a portion of the refrigeration required to cool feed gas from line 1 in representative flow passage 305. Additional refrigeration is provided by refrigerant introduced through line 13 which is warmed in representative flow passage 309.

Final vaporized hydrocarbon product is withdrawn a through line 15. Optionally, a portion of the vaporized hydrocarbon product is recycled through line 17 to increase methane recovery.

Combined feed cooler and stripping heat exchanger 301 typically is a brazed aluminum plate-and-fin core-type heat exchanger of the type described earlier for combined feed cooler and stripping heat exchanger 201. An advantageous feature of feed cooler and stripping heat exchanger 301 is that feed cooling and hydrocarbon liquid stripping are accomplished simultaneously in a single exchanger while both liquid and vapor hydrocarbon products are withdrawn therefrom.

Figure 4:
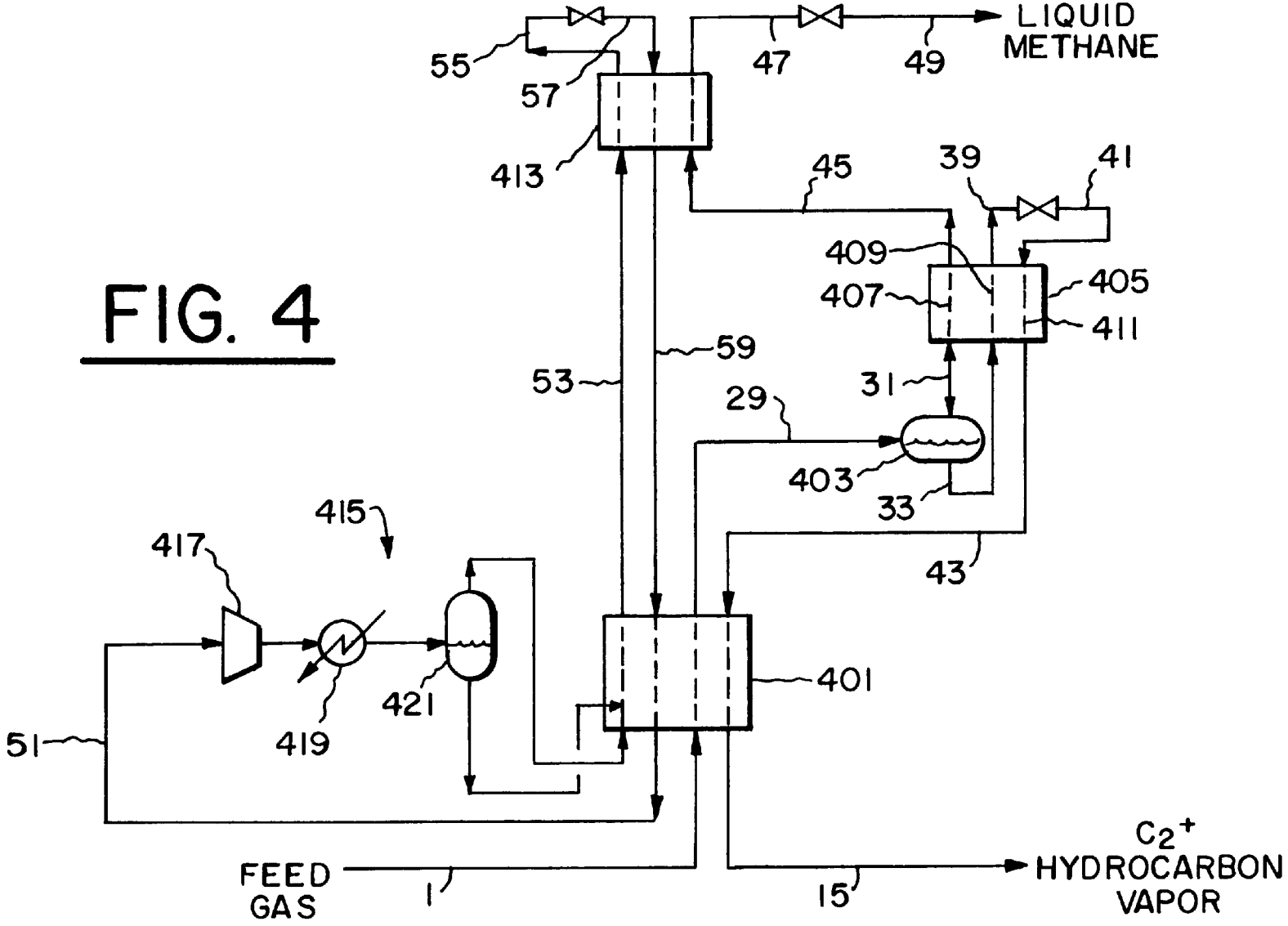
FIG. 4 is a schematic flow diagram of another alternative embodiment of the present invention.

An alternative embodiment of the invention is shown in FIG. 4 wherein a closed-loop mixed refrigerant cycle utilizing a multicomponent refrigerant mixture provides refrigeration to condense the high-purity methane product and to cool the feed gas prior to condensation and rectification in a dephlegmator. The mixed refrigerant can be flashed and vaporized at one or more pressure levels to provide refrigeration for cooling and liquefying the feed and for at least partially condensing and subcooling the multicomponent refrigerant mixture. The composition of the mixed refrigerant and the condensing and vaporizing pressure levels are selected to provide thermodynamically efficient temperature differences between the process streams and the mixed refrigerant streams in all of the heat exchangers. The mixed refrigerant can comprise relatively pure components, if available, or can be a suitable mixture of process streams such as a combination of one part of the methane-rich feed or product streams with several parts of the $C_2^+$ hydrocarbon product stream.

Referring now to FIG. 4, feed gas is introduced through line 1 into feed cooler heat exchanger 401, is cooled to near its dew point, and the cooled feed gas is introduced through line 29 into dephlegmator feed drum 403. Uncondensed vapor flows through line 31 into dephlegmator heat exchanger 405 wherein the vapor is further cooled, condensed, and rectified to remove most of the remaining $C_2^+$ hydrocarbons which are returned as liquid to dephlegmator feed drum 403 via line 31. Cooling, condensing, and rectification are effected in representative flow passage 407 wherein condensing liquid flows downward in simultaneous heat and mass transfer with vapor flowing upward in the flow passage.

Refrigeration for dephlegmator heat exchanger 405 is provided by withdrawing hydrocarbon liquid from dephlegmator feed drum 403 through line 33, subcooling the liquid in representative flow passage 409, reducing the pressure of the subcooled liquid from line 39, and introducing the reduced-pressure hydrocarbon liquid through line 41 into dephlegmator heat exchanger 405. The reduced-pressure hydrocarbon liquid is warmed in representative flow passage 411 to provide by indirect heat exchange the refrigeration required for cooling, condensing, and rectification in representative flow passage 407 and for subcooling in representative flow passage 409.

Warmed hydrocarbon is withdrawn from dephlegmator heat exchanger 405 in line 43 and can be introduced into feed cooler heat exchanger 401 where it is further warmed to provide a portion of the refrigeration required to cool feed gas provided in line 1. Warmed hydrocarbon vapor product is withdrawn through line 15.

In this embodiment, it may be preferable to remove any heavy hydrocarbon liquid which may condense in feed cooler 401 in a separate feed drum (not shown) upstream of dephlegmator feed drum 403. This ensures that only the lighter liquid condensed in the dephlegmator is utilized for refrigeration in the dephlegmator. This eliminates the potential for the freezing of heavier liquid components at the colder temperatures in the dephlegmator.

Cooled methane vapor is withdrawn from dephlegmator heat exchanger 405 through line 45 and is condensed and subcooled in product condenser 413 to yield high purity liquid methane product 47, which is reduced in pressure to yield final high purity methane liquid product in line 49.

Refrigeration for product condenser 413 and the additional refrigeration required for feed cooler heat exchanger 401 is provided by closed-loop refrigeration system 415. Refrigerant vapor typically comprising nitrogen, methane, and one or more hydrocarbons heavier than methane is provided in line 51 to compressor 417 where it is compressed to about 200–700 psia. The compressed refrigerant is cooled in cooler 419, the condensate (if any) is separated from the vapor in separator 421, and the vapor and condensate (if any) are combined, cooled, and condensed in feed cooler heat exchanger 401. The resulting cooled refrigerant in line 53 is further cooled and condensed in product condenser 413, the cooled refrigerant in line 55 is flashed to a lower pressure, and the flashed refrigerant in line 57 is warmed and vaporized in methane product condenser 413 to provide by indirect heat exchange the refrigeration for condensing the methane product 47 and for cooling the refrigerant from line 53.

Warmed refrigerant in line 59 is further warmed and vaporized in feed cooler heat exchanger 401 to provide a portion of the refrigeration for cooling the feed gas from line 1 and for cooling the mixed refrigerant from separator 421 described earlier. Warmed and vaporized refrigerant is returned to compressor 417 via line 51.

Dephlegmator heat exchanger 405 typically is a brazed aluminum plate-and-fin core-type heat exchanger as described above which includes multiple flow passages for cooling, condensing, and rectifying the vapor from line 31, for cooling hydrocarbon condensate from line 33, and for warming the reduced-pressure hydrocarbon liquid supplied via line 41.

EXAMPLE

Heat and material balances were carried out to illustrate the embodiment of FIG. 4. Natural gas stream 1 at 807 lbmoles per hour containing 1.5 mole % nitrogen, 95.4% methane and the balance ethane and heavier hydrocarbons ($C_2^+$) at 84° F. and 500 psia is cooled to −121° F. in feed cooler heat exchanger 401. The condensed liquid in line 29 is separated in dephlegmator feed drum 403, and 729 lbmoles per hour of uncondensed vapor is transferred through line 31 to dephlegmator heat exchanger 405 where it is further cooled, condensed, and rectified in representative flow passage 407 to remove most of the remaining $C_2^+$ hydrocarbons, which are returned to feed drum 403 via line 31. $C_2^+$ enriched hydrocarbon liquid is withdrawn from feed drum 403 through line 33 at 173 lbmoles per hour containing 12.7 mole % $C_2^+$ hydrocarbons and is subcooled to −133° F. in dephlegmator heat exchanger 405 to yield subcooled $C_2^+$ hydrocarbon liquid in line 39.

The subcooled $C_2^+$ hydrocarbon liquid is reduced in pressure to 255 psia and returned through line 41 to dephlegmator heat exchanger 405 where it is warmed and partially vaporized in representative flow channel 411 to supply refrigeration to the cooling streams as earlier described. The partially vaporized $C_2^+$ hydrocarbon liquid in line 43 is further vaporized in feed cooler heat exchanger 401 to provide refrigeration for cooling the feed gas and the pressurized mixed refrigerant as earlier described. Vaporized and warmed $C_2^+$ hydrocarbon vapor product is withdrawn at about 250 psia through line 15.

Methane-enriched overhead vapor stream at −133° F. is withdrawn from dephlegmator heat exchanger 405 through line 45 at 634 lbmoles per hour, and is condensed and subcooled to −261° F. in methane product condenser 413 for recovery as a high purity liquid methane product in line 47. The high pressure methane product stream 47 is at about 494 psia and contains 1.8 mole % nitrogen, 97.7% methane and 0.5% ethane. When let down to atmospheric pressure and passed through line 49 into storage, most of the nitrogen will flash off producing a 99+ mole % liquid methane product. In this example, more than 88% of the ethane and heavier hydrocarbons in the natural gas feed in line 1 are removed, and more than 80% of the methane in the natural gas feed in line 1 is recovered as high purity liquid methane product in line 49.

The necessary external refrigeration for feed cooler heat exchanger 401 and methane product condenser 413 is provided by multicomponent refrigeration (MR) system 415. A mixture of 10 mole % nitrogen, 35% methane and 55% heavier hydrocarbons in line 51 is compressed from 40 psia to 440 psia in MR compressor 417 and then cooled and partially condensed against cooling water in cooler 419. The vapor and liquid in mixed refrigerant stream 51 are separated in high pressure MR separator 421 prior to being remixed and partially condensed in feed cooler heat exchanger 401. The partially condensed mixed refrigerant stream 53 is then completely condensed and subcooled to −261° F. in methane product condenser 413 to yield subcooled refrigerant in line 55, before being let down in pressure to 47 psia. The reduced-pressure mixed refrigerant in line 57 at −265° F. is warmed and partially vaporized in methane product condenser 413, thereby condensing and subcooling the high pressure mixed refrigerant from line 53 and the methane-enriched dephlegmator heat exchanger overhead vapor in line 45. The resulting warmed and partially vaporized refrigerant in line 59 is introduced into feed cooler heat exchanger 401 where it is further warmed and completely vaporized to cool the high pressure mixed refrigerant from separator 421 and the feed gas from line 1. The resulting warmed refrigerant is returned through line 51 to MR compressor 417, thus completing the cycle.

The process described above reduces both the capital cost and the power required to remove ethane and heavier hydrocarbons ($C_2^+$) from natural gas or other methane-rich streams to produce a high purity liquid methane product. The dephlegmator heat exchanger provides 5 to 15 theoretical stages of separation which are typically necessary to produce a high purity methane product containing less than 0.5 mole % $C_2^+$ hydrocarbons with significantly less cost and complexity than a conventional distillation column. The overhead reflux condenser, reflux drum, reflux pumps, piping and valves required for a conventional distillation column are all eliminated. The dephlegmator also requires less refrigeration power than a conventional distillation column because refrigeration is provided over the entire temperature range of the rectification stages rather than only at the coldest temperature level as in a distillation column condenser.

Incorporating stripping heat exchange and feed cooling into a single exchanger (i.e. feed cooler and stripping heat exchanger 201 of FIG. 2 or feed cooler and stripping heat exchanger 301 of FIG. 3) is also less costly and more efficient than providing a separate reboiler or conventional reboiled stripping column to increase methane recovery or to increase the purity of the recovered $C_2^+$ hydrocarbon product. The mixed refrigerant cycle is also more efficient and less costly than conventional cascade or expander-type refrigeration systems. The composition of the multicomponent mixed refrigerant can be optimized to minimize the energy required for separation and liquefaction of the high purity liquid methane product. The mixed refrigerant may be partially condensed or it may be totally condensed and subcooled prior to flashing and vaporizing at lower pressure for refrigeration supply. For convenience, the vapor and liquid portions of the mixed refrigerant stream can be condensed and cooled separately or vaporized and warmed separately in any of the heat exchangers. Multiple vaporizing pressure levels of the mixed refrigerant can be used to reduce recompression energy where the associated power savings justify this approach.

The entire process of cooling and rectifying the feed gas, liquefying the high purity methane, stripping the $C_2^+$ hydrocarbon product, and providing the required refrigeration for all of these processing steps can be incorporated into a small number of heat exchangers to provide a highly cost effective and energy efficient process.

The essential characteristics of the present invention are described completely in the foregoing disclosure. One skilled in the art can understand the invention and make various modifications without departing from the basic spirit of the invention, and without deviating from the scope and equivalents of the claims which follow.

We claim:

1. A method for recovering methane from a feed gas mixture containing methane and one or more hydrocarbons heavier than methane which comprises:

(a) cooling the feed gas in a feed cooling heat exchange zone;

(b) further cooling, condensing, and rectifying the resulting cooled feed gas of step (a) in a dephlegmator to produce a cold methane vapor product and a hydrocarbon liquid enriched in the one or more hydrocarbons heavier than methane; and (c) vaporizing at least a portion of the hydrocarbon liquid of step (b) in the feed cooling heat exchange zone to provide by indirect heat exchange at least a portion of the refrigeration required to cool the feed gas in step (a), and withdrawing a vaporized hydrocarbon product from the feed cooling heat exchange zone.

2. The method of claim 1 which further comprises cooling and condensing the cold methane vapor product of step (b) to yield a high purity liquid methane product.

3. The method of claim 1 wherein at least a portion of the refrigeration required to cool the feed gas in the feed cooling heat exchange zone and to cool, condense, and rectify the cooled feed gas is provided by a closed-loop multicomponent refrigeration system.

4. The method of claim 3 wherein the closed-loop multicomponent refrigeration system utilizes a refrigerant comprising nitrogen, methane, and one or more hydrocarbons heavier than methane.

5. The method of claim 2 wherein the high purity liquid methane product contains at least about 98 mole % methane.

6. The method of claim 5 wherein the high purity liquid methane product contains less than about 0.5 mole % of hydrocarbons heavier than methane.

7. The method of claim 1 wherein a portion of the hydrocarbon liquid of step (b) is withdrawn as a liquid product.

8. The method of claim 1 wherein a portion of the vaporized hydrocarbon product is recycled and combined with the feed gas prior to step (a).

9. The method of claim 2 wherein at least a portion of the refrigeration required to cool and condense the cold methane vapor product is provided by an external refrigeration source.

10. The method of claim 9 wherein the external refrigeration source is a closed-loop multicomponent refrigeration system.

11. The method of claim 1 wherein at least a portion of the vaporization of the hydrocarbon liquid in step (c) in the feed cooling heat exchange zone is effected in one or more vertical passages such that the hydrocarbon liquid flows downward while hydrocarbon vapor formed therein flows upward and provides a stripping medium which enhances mass transfer between the vapor and liquid phases, and wherein the vapor thus formed is withdrawn from the feed cooling heat exchange zone and is introduced into the dephlegmator.

12. The method of claim 11 wherein a portion of partially vaporized hydrocarbon liquid is withdrawn from an intermediate point of the feed cooling heat exchange zone.

13. The method of claim 12 wherein the remaining portion of the partially vaporized hydrocarbon liquid is further vaporized in the feed cooling heat exchange zone to provide the vaporized hydrocarbon product withdrawn therefrom.

14. The method of claim 13 wherein a portion of the vaporized hydrocarbon product is recycled and combined with the feed gas prior to step (a).

15. A method for recovering methane from a feed gas mixture containing methane and one or more hydrocarbons heavier than methane which comprises:

(a) cooling the feed gas in a feed cooling heat exchange zone;

(b) further cooling, condensing, and rectifying the resulting cooled feed gas of step (a) in a dephlegmator to produce a cold methane vapor product and a hydrocarbon liquid enriched in the one or more hydrocarbons heavier than methane;

(c) subcooling at least a portion of the hydrocarbon liquid of step (b), reducing the pressure of the resulting subcooled liquid, and warming the resulting reduced-pressure hydrocarbon stream in the dephlegmator to provide by indirect heat exchange at least a portion of the refrigeration for the cooling and rectifying in step (b); and (d) removing from the dephlegmator an intermediate temperature hydrocarbon stream.

16. The method of claim 15 wherein the subcooling of the hydrocarbon liquid of step (c) is effected by indirect heat exchange with the reduced-pressure hydrocarbon stream in the dephlegmator.

17. The method of claim 15 wherein the intermediate temperature hydrocarbon stream removed from the dephlegmator is warmed by indirect heat exchange with the feed gas in the feed cooling heat exchange zone to provide at least a portion of the refrigeration required to cool the feed gas, and a warm vaporized hydrocarbon stream is withdrawn therefrom.

18. The method of claim 17 wherein a portion of the warm vaporized hydrocarbon stream is recycled and combined with the feed gas prior to step (a).

19. The method of claim 15 which further comprises cooling and condensing the cold methane vapor product of step (b) to yield a high purity liquid methane product.

20. The method of claim 19 wherein at least a portion of the refrigeration required to cool the feed gas in the feed cooling heat exchange zone and to cool and condense the cold methane vapor product is provided by a closed-loop multicomponent refrigeration system.

21. The method of claim 20 wherein the closed-loop multicomponent refrigeration system utilizes a refrigerant comprising nitrogen, methane, and one or more hydrocarbons heavier than methane.

* * * * *